United States Patent [19]

Ballyns et al.

[11] Patent Number: 4,932,232

[45] Date of Patent: Jun. 12, 1990

[54] METHODS OF DETECTING AND CORRECTING SPRAY HEADER MALFUNCTIONS

[75] Inventors: Jeff Ballyns, Oswego; Otto Meijer, Fulton; Herbert R. Powers, Oswego, all of N.Y.

[73] Assignee: Alcan Aluminum Corporation, Cleveland, Ohio

[21] Appl. No.: 196,307

[22] Filed: May 20, 1988

[51] Int. Cl.[5] ..... B21B 45/02; B05B 1/16

[52] U.S. Cl. ..... 72/201; 239/74; 239/563

[58] Field of Search ..... 72/200, 201, 236; 222/40, 71, 72; 239/69, 74, 551, 562, 563

[56] References Cited

U.S. PATENT DOCUMENTS

| | | | |
|---|---|---|---|
| 4,247,047 | 1/1981 | Schaming | 72/201 X |
| 4,262,511 | 4/1981 | Boisvert et al. | 72/201 X |
| 4,392,367 | 7/1983 | Bald | 72/12 |
| 4,467,629 | 8/1984 | Schimion | 72/17 |
| 4,510,784 | 4/1985 | Hsu | 72/201 |
| 4,637,547 | 1/1987 | Hiniker et al. | 239/69 X |
| 4,706,480 | 11/1987 | Svatos | 72/17 |

*Primary Examiner*—E. Michael Combs

*Attorney, Agent, or Firm*—Cooper & Dunham

[57] ABSTRACT

A method of detecting spray header valve and nozzle malfunctions, in a spray header including plural nozzles each having its own control valve, by supplying the spray header with liquid at a constant pressure head through a conduit while opening and closing the nozzle valves one at a time, and measuring the flow rate through the conduit each time one of the valves is open and when all the valves are closed. In response to detection of a malfunction at a particular nozzle, the valves of one or more adjacent nozzles are adjusted so that the adjacent-nozzle flow rates compensate for the malfunction, for example to maintain a desired cooling pattern across a surface being cooled by the spray header notwithstanding the malfunction at the particular nozzle.

8 Claims, 1 Drawing Sheet

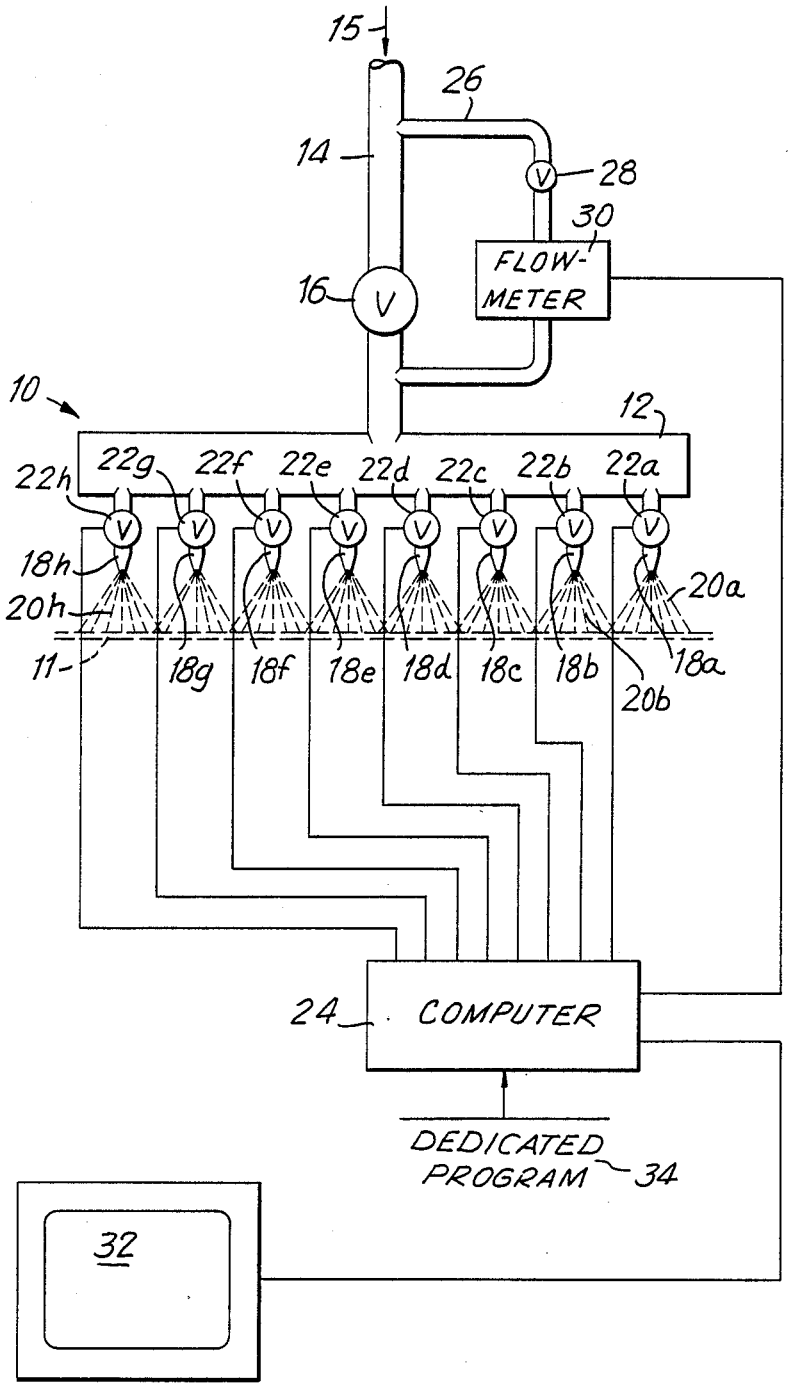
15
26
14
28
30
FLOW-METER
16
10
12
22h
22g
22f
22e
22d
22c
22b
22a
18h
20h
20a
11
18g
18f
18e
18d
18c
18b
18a
20b
24
COMPUTER
DEDICATED PROGRAM
34
32

METHODS OF DETECTING AND CORRECTING SPRAY HEADER MALFUNCTIONS

BACKGROUND OF THE INVENTION

This invention relates to methods of diagnosing and compensating for malfunctions of a spray header. In a particular sense, the invention is directed to methods of detecting and correcting such malfunctions in rolling mill spray cooling systems.

Mills for rolling metal sheet (strip) commonly employ spray headers for cooling roll and/or strip surfaces with sprays of liquid coolant. As contemplated herein, a spray header is a device having a manifold and a plurality of nozzles each including (and controlled by its own valve, the nozzles being arranged side by side to discharge, in parallel, sprays of a liquid supplied to the manifold. A rolling mill spray header is typically operated to distribute sprayed liquid coolant substantially uniformly across the surface of a roll or strip, although controlled nonuniform distribution may be provided for particular purposes. It is known to control the nozzle valves, for example by a suitable computer, in response to sensed variations in pertinent temperature conditions.

Difficulty has heretofore been encountered in detecting and correcting spray header malfunctions such as total or partial clogging of a nozzle or failure of its valve (reference herein to valve failure will be understood to include failure of the valve itself and/or of any actuator means or mechanism associated therewith). When valve or nozzle malfunction occurs, delivery, of spray through the affected nozzle is impaired or interrupted, and the roll or strip surface portion sprayed by that nozzle receives inadequate or excessive coolant, with potentially deleterious consequences. In a rolling mill, it is frequently not feasible to ascertain individual nozzle valve malfunctions by direct visual inspection, and diagnostic as well as corrective procedures have necessitated time-consuming shutdown of the mill.

SUMMARY OF THE INVENTION

The present invention, in a first aspect, broadly contemplates the provision of a method for detecting malfunctions of individual nozzles and/or nozzle valves in a spray header having a manifold receiving liquid from a supply line and from which liquid is discharged, in parallel sprays, through a plurality of nozzles adjacent each other and separately controlled by a corresponding plurality of individual valves respectively associated with the nozzles. The method in accordance with the invention comprises the steps of continuously supplying liquid under a constant pressure head to the manifold through a conduit, after initially closing all the valves, while measuring the flow rate of liquid through the conduit when all the valves are closed, successively opening and closing each of the valves with all the other valves maintained in closed condition, and measuring the flow rate of liquid through the conduit each time one of the valves is opened; and deriving, from the flow rate measurements thus made, an indication for each nozzle as to the existence (and, if present, the effect on nozzle discharge) of a malfunction at that nozzle. Reference herein to a malfunction at a nozzle will be understood to mean a malfunction of the nozzle and/or of its associated valve.

As a further feature of the invention, the supply line through which liquid is supplied to the manifold during operation of the spray header may be of larger diameter than the conduit, and delivery of liquid to the manifold through the supply line may be prevented throughout performance of the flow-rate-measuring steps. Also, conveniently or preferably in many cases, data derived from the flow rate measurements may be visibly displayed.

In a second aspect, the invention contemplates the provision of a method of compensating for valve and/or nozzle malfunctions in a spray header of the type described, including performing the foregoing steps for detecting such malfunction, and, in response to an indication of malfunction thus derived, performing the further step of setting the valve or valves associated with one or more nozzles adjacent the nozzle at which the malfunction is indicated so as to provide a magnitude of spray discharge (i.e., through the adjacent nozzle or nozzles) effective to compensate for the indicated malfunction. Thus, in a system wherein the spray header is arranged to effect spray cooling of a surface in accordance with a preselected thermal model of cooling spray distribution across the surface, and wherein each of the nozzle valves is ordinarily set at a nominal setting determined by the thermal model, the requisite adjustment of the adjacent-nozzle valve or valves may be determined by calculating, from the thermal model, and from the indication of malfunction, the extent to which and the direction in which the adjacent-nozzle valve or valves must depart from its or their nominal setting or settings to compensate for the malfunction.

The method of the invention enables advantageously simple and rapid diagnosis of and compensation for malfunctions of spray header nozzles and nozzle valves, e.g. during periods between rolling of successive sheets (coils), and thus effectively on-line (requiring no mill shutdown). It has particular utility for spray headers arranged to provide spray cooling of a roll or strip surface in a sheet metal rolling mill.

Further features and advantages of the invention will be apparent from the detailed description hereinbelow set forth, together with the accompanying drawing.

BRIEF DESCRIPTION OF THE DRAWING

The single figure is a highly schematic and partly diagrammatic view of a spray header arranged to provide spray cooling in a rolling mill and incorporating an illustrative system for performing the method of the present invention.

Detailed Description

Referring to the drawing, the invention will be described as embodied in a method for detecting and correcting malfunctions in a generally conventional spray header 10 arranged for use in spray cooling a surface (double broken line 11) of a strip or roll in a rolling mill for producing sheet metal (strip). Header 10 includes a manifold 12, extending transversely of the surface 11 and in spaced relation thereto, for receiving a coolant liquid such as water delivered to the manifold through a main supply line 14 (as indicated by arrow 15) under control of a shutoff valve 16. The spray header also includes a plurality of nozzles 18 (eight being shown, respectively designated 18*a*, 18*b*, . . . 18*h*) projecting from the manifold in side-by-side relation to each other along the length thereof for discharging, in parallel, plural sprays 20 of the coolant liquid from the manifold 12 onto the surface 11 which is to be cooled. Typically these sprays overlap at the surface 11 for assured complete coverage of the surface with the sprayed coolant.

Each of the nozzles 18 in the header 10 is provided with its own individual valve 22 for controlling flow of coolant liquid from the manifold through and out of the nozzle; thus, for the eight illustrated nozzles 18*a*. . . 18*h* there are provided eight valves, respectively designated 22*a*, 22*b* . . . 22*h* and respectively connected to their associated nozzles. Each valve 22 can be a flow control valve or, more commonly, a solenoid-operated on-off (open-closed) valve. Each of these valves can be adjusted between a full shutoff and a full open position to permit individual selection of the coolant spray discharge flow rate, for the associated nozzle, through a range from zero (full shutoff) to a maximum value (full open). For example, in some spray headers of this type, flow rate can be controlled by pulsing between full-closed and full-open position. All eight nozzles in the system shown are identical, as are their valves. It will of course be appreciated that the number of nozzles shown is merely exemplary.

Conveniently, the nozzle valves 22 are individually operated by a common control system represented as including a computer 24 which separately sets the nozzle flow rate for each valve. For solenoid valves, this is done by varying the duty cycle (on versus off time) via pulsing, as a common practice. In a typical example of operation, to which detailed reference will be made hereinafter, all the valve settings are at preselected values somewhat below maximum flow condition, to provide substantially uniform coolant distribution at a desired or selected rate over the entire surface 11. The control system may also include a manual override (not indicated in the drawing) for operating any or all of the valves.

While the mill is running to roll metal strip, the spray header operates continuously to provide desirably continuous cooling. It sometimes happens, however, that one or more of the nozzles 18 becomes partially or even totally clogged, and/or that one or more of the valves 22 fails partially or completely in either closed or open position. When this occurs, the desired uniformity of spray distribution (or other desired distribution pattern) is disrupted. For example, if a nozzle is clogged, or if its valve fails to open to the desired intent, the discharge of spray through that nozzle is reduced or interrupted, and the portion of surface 11 receiving spray from the affected nozzle suffers a diminution of cooling effect. To the extent that cooling conditions are critical in the strip-rolling operation, prompt correction of such a malfunction is important.

Detection of individual nozzle or valve malfunction by on-line visual inspection in a rolling mill is difficult if not impossible, especially where the spray headers include large banks or batteries of nozzles. Although in conventional rolling mill operation, where sheets (coils) of metal are rolled in succession, there is an interval (termed "between-coil time", and typically on the order of, say, 30 to 45 seconds) between the trailing end of one sheet and the leading edge of the next successive sheet, it has not heretofore been possible to utilize between-coil time for detection and correction of nozzle and valve malfunctions. Thus, shutdown of the mill and visual inspection have been necessary to test the spray headers. Shutdown has also heretofore been necessary to correct such malfunctions. The loss of production time involved in these shutdowns is inconvenient and uneconomical.

The method of the present invention, now to be described, overcomes the foregoing difficulties by providing rapid failure diagnostics and automatic compensation during between-coil time, i.e. during the aforementioned intervals between successive sheets (coils). In the illustrated system for the practice of this method, a small-bore conduit 26, under control of a shutoff valve 28, is connected as a bypass line around the main shutoff valve 16 of supply line 14 so that, when valve 16 is closed and valve 28 is opened, liquid advancing in line 14 flows to the spray header 10 through and only through the small-bore bypass line 26. A suitable and e.g. conventional flowmeter 30 is connected in the bypass line 26 to measure the volume rate of liquid flow therethrough and is arranged to transmit a signal representative of such measured value to the computer 24. The computer is operatively associated with a video display unit 32, and (for compensation purposes, as hereinafter explained) is provided with a dedicated program 34.

Assuming that the mill is rolling strip, the present method in its diagnostic aspect is performed, to measure individual nozzle function and valve response, by first closing all the valves 22 to full shutoff position so that no liquid is discharged from any of the nozzles, closing valve 16 to shut off liquid delivery through main supply line 14, and opening valve 28. Liquid can now flow into the manifold 12 only through bypass line 26, but with all the valves 22 shut off, this flow should be zero. The flow rate through line 26 as sensed by meter 30 is displayed on unit 32 to confirm that it is zero at this time.

Next, the valves 22*a* . . . 22*h* are individually opened and shut in sequence, while the supply of liquid represented by arrow 15 is maintained at a constant, preselected pressure head. Thus, valve 22*a* is switched from full-closed to full-open condition while all the other valves . . . 22*b* 22*h* remain fully shut. The resultant flow rate through line 26 is sensed by flowmeter 30 and the meter readout is displayed visually by unit 32, e.g. for comparison with a normative value, viz. the known or predetermined value of flow rate (through line 26, at the aforementioned pressure head) corresponding to the condition in which there is a single properly functioning valve 22 (and fully unclogged nozzle 18) fully open, and in which all the other valves are properly functioning and fully shut. If the flow rate thus determined for valve 22*a*/nozzle 18*a* equals the normative value, it is functioning properly; if the measured flow rate is less than the normative value (or zero), partial or total failure of valve 22*a* and/or clogging of nozzle 18*a* is indicated, the extent of such malfunction being represented by the discrepancy between the measured and normative values. For fast-switching valves such as solenoid valves one can also measure the switching rate and time to obtain full flow to diagnose the dynamic performance of the valve.

Valve 22*a* is then shut, and the abovedescribed procedure is repeated for valve 22*b* (i.e., with valves 22*a* and 22*c* . . . 22*h* all fully shut), and thereafter in succession for each of valves 22*c* through 22*h*. In this was data are developed and recorded for the condition of each individual valve/nozzle unit in the spray header 10.

If one or more of the valves 22 has failed in an open or semi-open condition, the initial or zero readout from flowmeter 30 (with all these valves controlled to full-closed position) will be greater than zero, i.e. a positive value. The normative value may then be adjusted by this positive value in the testing of all the valves. When the valve stuck in open or semi-open condition is reached in the abovedescribed testing sequence, it will give an anomalous flowmeter reading (as compared to the readings for the other valves), i.e. a reading below the adjusted normative value, immediately indicating its malfunction.

As a practical matter, the described diagnostic procedure may be performed without resort to a formally established normative value, but simply by observing the "zero reading" (all valves closed) of flow rate, and the flow rate attained as each valve is opened (with the others remaining shut) in sequence, and noting anomalies. Also, the diagnostic procedure may be performed by a suitably programmed computer rather than, or in parallel with, display of data on unit 32 for operator viewing. Stated more broadly, from the readouts of flow rate (viz., with all valves 22 closed, and then with each valve in succession fully open while all others remain closed) there is derived an indication of the presence or absence and (if present) the effect on nozzle discharge of a malfunction at each individual nozzle. Conveniently, in the illustrated system, the computer 24 is utilized to receive the readouts from the flowmeter 30 (as well as to effect the sequential opening and closing of successive valves 22, in conjunction therewith) and to present the data for viewing on unit 32 in any desired format.

Provision of the small-bore bypass line or conduit 26 for the diagnostic procedure avoids the necessity of mounting the flowmeter 30 in the main supply line 14, and also facilitates rapid and accurate flow rate measurements for detecting individual valve/nozzle malfunctions, since the small-volume flow through line 26 responds quickly and significantly when one of the nozzle valves 22 is opened, and in particular, since flowmeters for measuring relatively small volume flow rates are less expensive and more accurate than those available for use with large volume flow rates.

Once the diagnostic procedure is completed for all valves 22/nozzles 18, valve 28 is closed and valve 16 is reopened to restore flow of coolant liquid through the main supply line 14. At the same time, all the valves 22 are reopened to their preselected settings to resume desired uniform (or other) spray flow rates through the nozzles, except that if a malfunction at a particular nozzle has been detected during the diagnostics procedure, the settings of the valve or valves of one or more adjacent nozzles may be adjusted to compensate for the malfunction, in accordance with the compensation aspect of the invention, now to be described.

More particularly, in response-to an indication of malfunction at any nozzle derived in the diagnostic procedure, the valve or valves 22 of one or more nozzles adjacent the nozzle at which the indicated malfunction exists are set at altered pulsing cycles (or increased or decreased openings) to provide increased or decreased spray discharge such as to compensate for the indicated malfunction. For example, if nozzle **18*d* is completely clogged, so that there is no flow measured by meter 30 when its valve is individually opened during the diagnostic procedure, then upon resumption of coolant supply through line 14, valves 22*c* and 22*e* are operated at settings that depart from their normal or preselected settings, by such an amount as to provide increased discharge of coolant through their nozzles 18*c* and 18*e* sufficient to make up for the lack of discharge through nozzle 22*d*, and thereby to insure adequate cooling of the portion of surface 11** ordinarily sprayed by the latter nozzle. Conversely, if a nozzle valve is found to be stuck in full open position, the valves of adjacent nozzles are reduced to below-normal settings to avoid excessive cooling of the strip portion sprayed by the nozzle having the malfunctioning valve.

Conveniently, the compensating adjustment is performed by the computer 24, which may for this purpose be provided with a dedicated program 34 for calculating, from a thermal model, the amount of adjustment of adjacent-nozzle flow necessary to compensate for a malfunction at a given nozzle, i.e., after the computer has received and processed flowmeter readouts from the diagnostic procedure to determine the existence of a malfunction at that nozzle and the magnitude and direction (excess or deficiency) of the effect of the malfunction on nozzle discharge flow rate. Both the diagnostics and compensation aspects of the present method can be performed on-line (i.e., during between-coil times, without requiring mill shutdown) in a rapid and automatic manner; if a single between-coil time is insufficient to complete a diagnostic procedure, it is interrupted at the end of the between-coil interval and resumed at the same point at the next between-coil time. Malfunction data obtained by the diagnostic procedure can also be stored or recorded for use, during the next regular mill shutdown, in taking mechanical corrective steps such as unclogging a nozzle or fixing a valve, but the compensation procedure of the invention obviates interruption of mill operation for such mechanical maintenance.

The invention can equally well be employed to compensate for the effects of an indicated malfunction at a nozzle on either a uniform spray distribution or a desired nonuniform spray distribution, by adjustment of the valve settings of one or more adjacent nozzles in such manner as to restore the desired cooling pattern in accordance with a thermal model. In other words, the desired coolant distribution (whether uniform or nonuniform) is reduced to a thermal model, with a particular nominal setting assigned to the valve 22 of each nozzle 18 on the assumption that all valves and nozzles are functioning properly. Then, upon input of data (from the above-described diagnostic procedure) representing the existence, location, and effect on nozzle discharge of a malfunction at a particular nozzle, the effect of such malfunction on the thermal model and the necessary compensating departure of adjacent-nozzle valve settings from their nominal values are calculated, and these adjacent valve settings are adjusted accordingly upon resumption of normal coolant supply to the spray header.

Also, while the diagnostics and compensation methods of the invention are particularly advantageous for rolling mill spray cooling, in a broad sense they are applicable generally to spray headers having plural, individually valve-controlled nozzles in a straight line, circular or other array.

It is to be understood that the invention is not limited to the procedures and embodiments hereinabove specifically set forth but may be carried out in other ways without departure from its spirit.

We claim:

1. For use with a spray header having a manifold receiving liquid from a supply line and from which liquid is discharged, in parallel sprays, through a plurality of nozzles adjacent each other and separately controlled by a corresponding plurality of individual valves respectively associated with the nozzles, a method of detecting malfunctions of individual ones of said nozzles and/or their associated valves, said method comprising (a) continuously supplying liquid under a constant pressure head to said manifold through a conduit, after initially closing all said valves, while (b) measuring the flow rate of liquid through said conduit when all said valves are closed, (c) successively opening and closing each of said valves with all the other valves maintained in closed condition, and (d) measuring the flow rate of liquid through said conduit each time one of the valves is open during performance of step (c); and (e) deriving, from the flow rate measurements made in steps (b) and (d), an indication for each nozzle as to the existence, and if present the effect on nozzle discharge, of a malfunction at that nozzle.

2. A method according to claim 1, wherein during operation of said spray header said manifold is supplied with liquid through a supply line of larger diameter than said conduit, and wherein delivery of liquid to said manifold through said supply line is prevented throughout performance of steps (b), (c) and (d).

3. A method according to claim 1, further including visibly displaying data derived from the flow rate measurements made in steps (b) and (d).

4. A method according to claim I, wherein said ray header is arranged to effect spray cooling in a rolling mill for producing metal sheet, said liquid being a coolant liquid.

5. For use with a spray header having a manifold receiving liquid from a supply line and from which liquid is discharged, in parallel sprays, through a plurality of nozzles adjacent each other and separately controlled by a corresponding plurality of individual valves respectively associated with the nozzles, each of said valves being adjustable to vary the flow rate through its associated nozzle, a method of compensating for malfunctions of individual ones of said nozzles and/or their associated valves, said method comprising (a) detecting valve and/or nozzle malfunctions by (i) continuously supplying liquid under a constant pressure head to said manifold through a conduit, after initially closing all said valves, while (ii) measuring the flow rate of liquid through said conduit when all said valves are closed, (iii) successively opening and closing each of said valves with all the other valves maintained in closed condition, and (iv) measuring the flow rate of liquid through said conduit each time one of the valves is open during performance of step (iii); and (v) deriving, from the flow rate measurements made in steps (ii) and (iv), an indication for each nozzle as to the existence, and if present the effect on nozzle discharge, of a malfunction at that nozzle; and (b) upon deriving an indication of malfunction at one of said nozzles, and in response to said indication, setting at least one valve associated with a nozzle adjacent said one nozzle to provide a flow rate through said adjacent nozzle having a magnitude effective to compensate for the indicated malfunction at said one nozzle.

6. A method according to claim 5, wherein said spray header is arranged to effect spray cooling of a surface in a rolling mill for producing metal sheet, said liquid being a coolant liquid; wherein, in the absence of any valve or nozzle malfunction, during operation of said spray header for spray cooling said surface each of said valves is set at a nominal setting determined by a preselected thermal model of cooling spray distribution across said surface; and wherein step (b) comprises calculating, from the thermal model, and from the indication of malfunction at said one nozzle, the extent to which and the direction in which the valve associated with said adjacent nozzle must depart from its nominal setting to compensate for the last-mentioned malfunction, and adjusting the setting of the last-mentioned valve accordingly.

7. A method according to claim 5, wherein said spray header is arranged to effect spray cooling of a surface in a rolling mill for producing metal sheet, said liquid being a coolant liquid and being supplied to said manifold, during spray-cooling operation, through a supply line of larger diameter than said conduit; wherein delivery of coolant liquid to the manifold through the supply line is prevented throughout performance of steps (a)-(ii), (iii) and (iv) and is resumed upon performance of step (b); wherein, in the absence of any valve or nozzle malfunction, during operation of said spray header for spray cooling said surface each of said valves is set at a preselected setting; and wherein step (b) comprises changing the setting of the valve associated with said adjacent nozzle from its preselected setting in a direction and amount sufficient to compensate for the malfunction at said one nozzle.

8. A method according to claim 5, wherein step (b) comprises setting at least two valves respectively associated with nozzles adjacent said one nozzle to provide flow rates, through said adjacent nozzles, cooperatively effective to compensate for said malfunction.

* * * * *